US011633078B2

(12) United States Patent
Fletcher Walker et al.

(10) Patent No.: US 11,633,078 B2
(45) Date of Patent: Apr. 25, 2023

(54) VACUUMING FAUCET ASSEMBLY

(71) Applicants: Carol Fletcher Walker, Bronx, NY (US); Leah Walker, Bronx, NY (US)

(72) Inventors: Carol Fletcher Walker, Bronx, NY (US); Leah Walker, Bronx, NY (US)

( * ) Notice: Subject to any disclaimer, the term of this patent is extended or adjusted under 35 U.S.C. 154(b) by 287 days.

(21) Appl. No.: 17/108,296

(22) Filed: Dec. 1, 2020

(65) Prior Publication Data

US 2022/0167807 A1 Jun. 2, 2022

(51) Int. Cl.

| | |
|---|---|
| ***A47L 7/00*** | (2006.01) |
| ***E03C 1/04*** | (2006.01) |
| ***A47L 9/28*** | (2006.01) |
| ***B08B 5/04*** | (2006.01) |
| ***A47L 9/02*** | (2006.01) |

(52) U.S. Cl.

CPC ..... *A47L 7/0009* (2013.01); *A47L 9/02* (2013.01); *A47L 9/2805* (2013.01); *B08B 5/04* (2013.01); *E03C 1/04* (2013.01); *E03C 2201/80* (2013.01)

(58) Field of Classification Search

CPC ..... A47L 7/0009; E03C 1/04; E03C 2201/80
See application file for complete search history.

(56) References Cited

U.S. PATENT DOCUMENTS

| | | | | |
|---|---|---|---|---|
| 1,437,006 | A * | 11/1922 | Otterson | E03F 7/10 134/22.18 |
| 1,933,165 | A * | 10/1933 | Dewey | D06F 39/08 417/195 |
| 2,377,539 | A * | 6/1945 | Collins | A47B 83/00 297/143 |
| 3,803,642 | A * | 4/1974 | Erling | A47K 3/06 4/587 |
| 4,336,619 | A | 6/1982 | Hinkel | |
| 5,915,851 | A | 6/1999 | Wattrick | |
| 6,453,488 | B1 | 9/2002 | Shamroth | |
| 7,228,874 | B2 | 6/2007 | Bolderheij | |
| D674,967 | S | 1/2013 | Figurski | |
| 9,758,953 | B2 | 9/2017 | Bayley | |
| 10,638,893 | B2 | 5/2020 | Muderlak | |
| 2018/0259256 | A1 * | 9/2018 | Kim | A47K 1/00 |

FOREIGN PATENT DOCUMENTS

| | | |
|---|---|---|
| WO | WO2013142224 | 9/2013 |

* cited by examiner

*Primary Examiner* — J C Jacyna

(57) ABSTRACT

A vacuuming faucet assembly includes a faucet that is integrated into a counter top. A pair of vacuum units is each integrated into the faucet and each of the vacuum units includes a suction port that is in fluid communication with a vacuum source. The suction port on each of the vacuum units is extendable away from a respective vacuum unit for suctionally removing water from the counter top to dry the counter top. A plurality of motion sensors is each integrated into a respective one of the faucet and a respective one of the pair of vacuum units to sense motion proximate the respective faucet and the respective pair of vacuum units. Additionally, respective ones of the motion sensors turns on the respective faucet of the respective vacuum unit when the respective motion sensor senses motion.

17 Claims, 5 Drawing Sheets

VACUUMING FAUCET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to vacuuming devices and more particularly pertains to a new vacuuming device for suctionally removing water from a counter top. The vacuuming device is integrated into a faucet to facilitate seamless installation into a countertop, such as a kitchen or bathroom countertop. Additionally, the vacuuming device is plumbed into the existing sewer system to which the faucet is plumbed.

(2) Description of Related Art Including Information Disclosed Under 37 CFR 1.97 and 1.98

The prior art relates to vacuuming devices including a variety of hand washing devices that includes a blower for drying a user's hands when the user finishes washing their hands. The prior art also discloses a faucet that include an air blowing spout being integrated therein for blowing air to dry a surface. In no instance does the prior art disclose a faucet that has a vacuuming unit integrated therein for sucking, rather than blowing, air.

BRIEF SUMMARY OF THE INVENTION

An embodiment of the disclosure meets the needs presented above by generally comprising a faucet that is integrated into a counter top. A pair of vacuum units is each integrated into the faucet and each of the vacuum units includes a suction port that is in fluid communication with a vacuum source. The suction port on each of the vacuum units is extendable away from a respective vacuum unit for suctionally removing water from the counter top to dry the counter top. A plurality of motion sensors is each integrated into a respective one of the faucet and a respective one of the pair of vacuum units to sense motion proximate the respective faucet and the respective pair of vacuum units. Additionally, respective ones of the motion sensors turns on the respective faucet of the respective vacuum unit when the respective motion sensor senses motion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
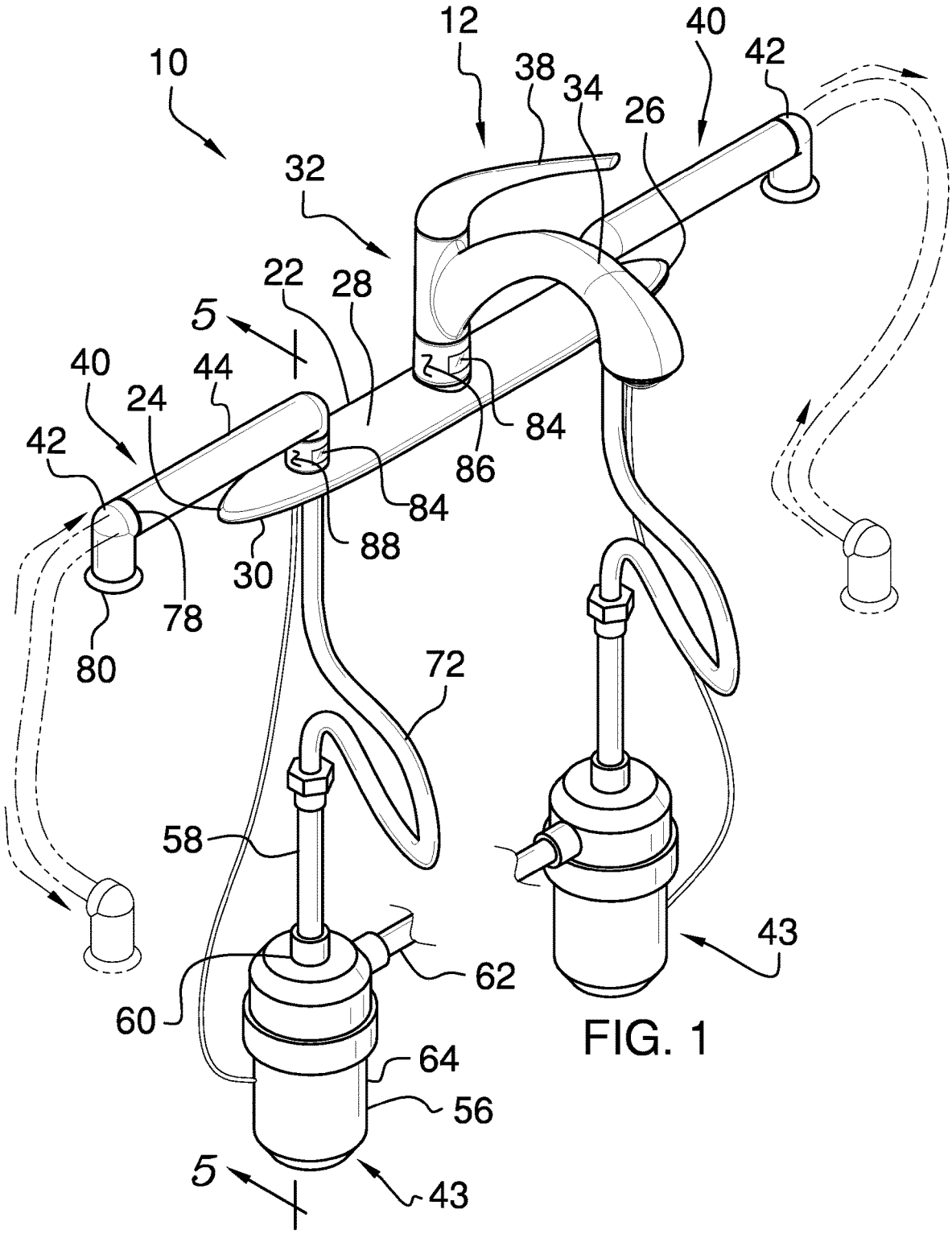
FIG. 1 is a perspective view of a vacuuming faucet assembly according to an embodiment of the disclosure.
Figure 2:
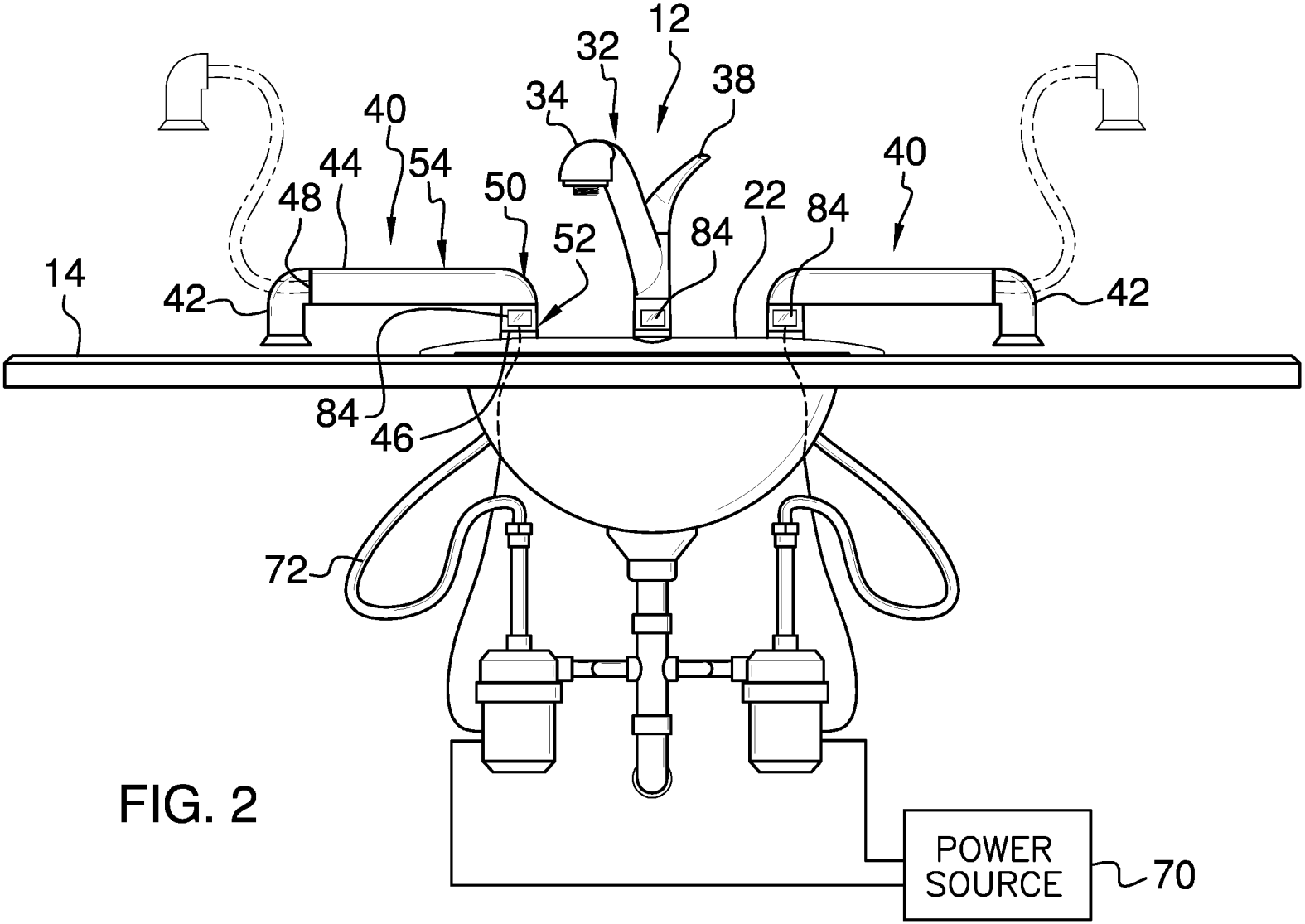
FIG. 2 is a front view of an embodiment of the disclosure.
Figure 3:
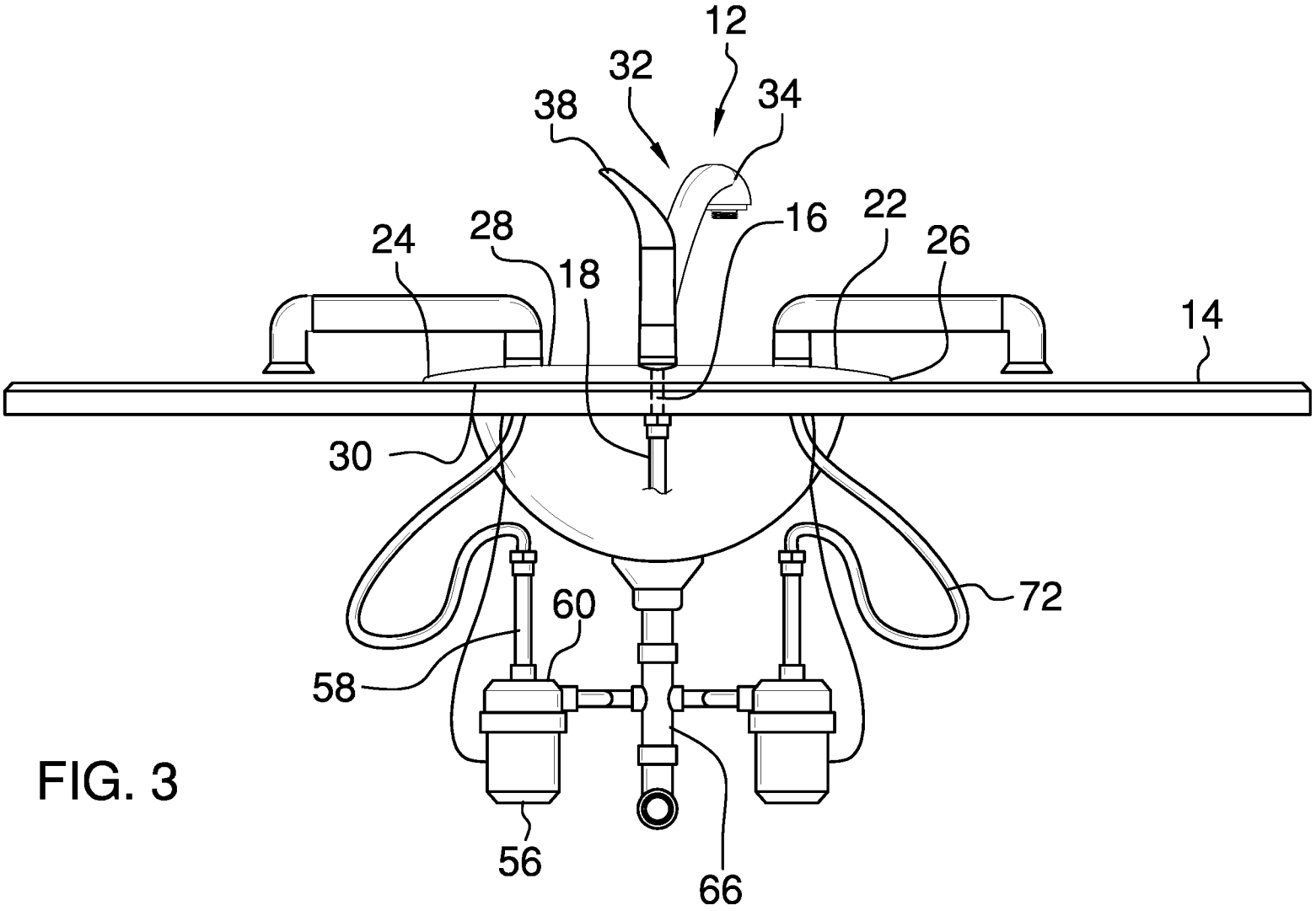
FIG. 3 is a back view of an embodiment of the disclosure.
Figure 4:
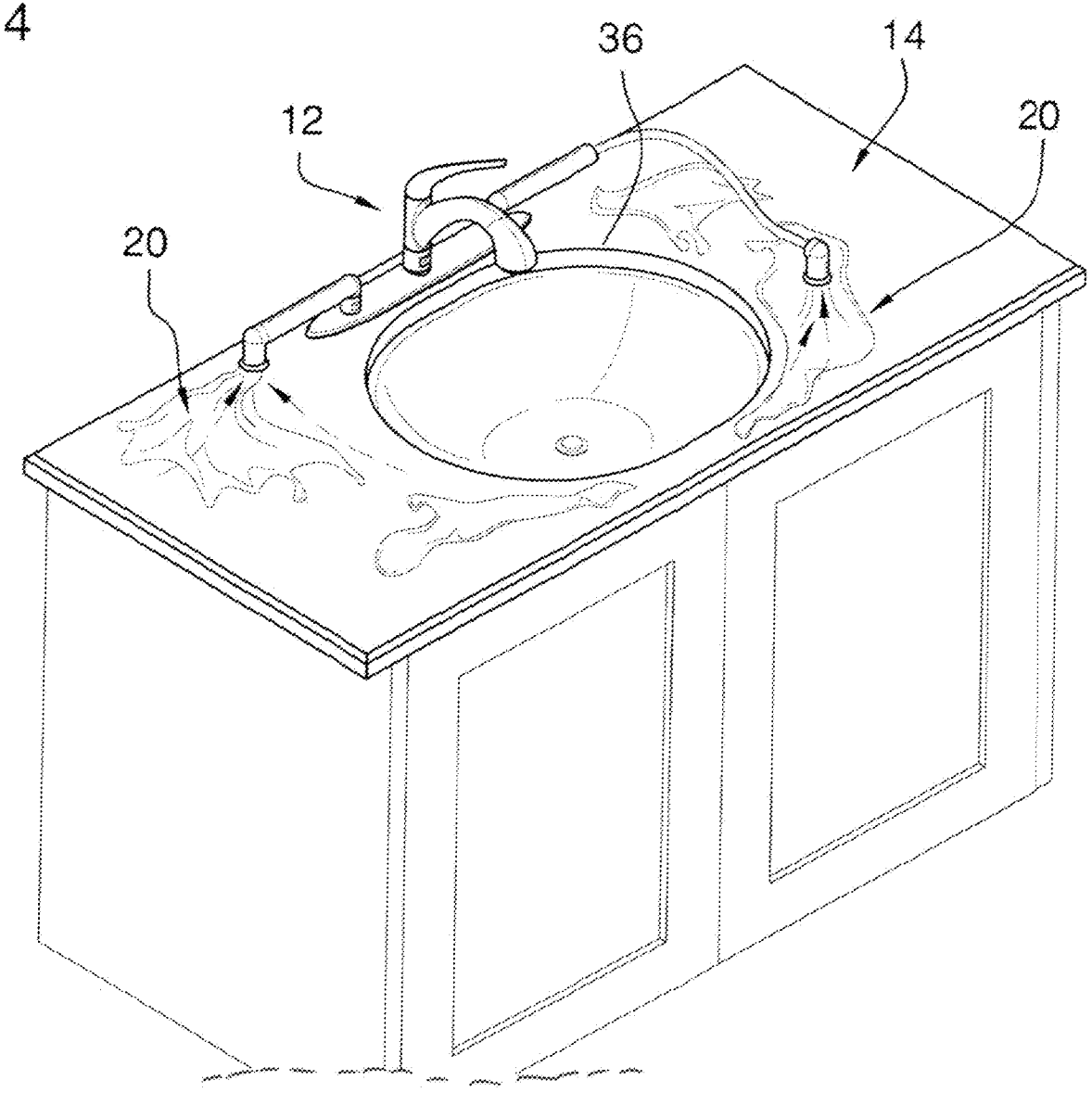
FIG. 4 is a perspective in-use view of an embodiment of the disclosure.
Figure 5:
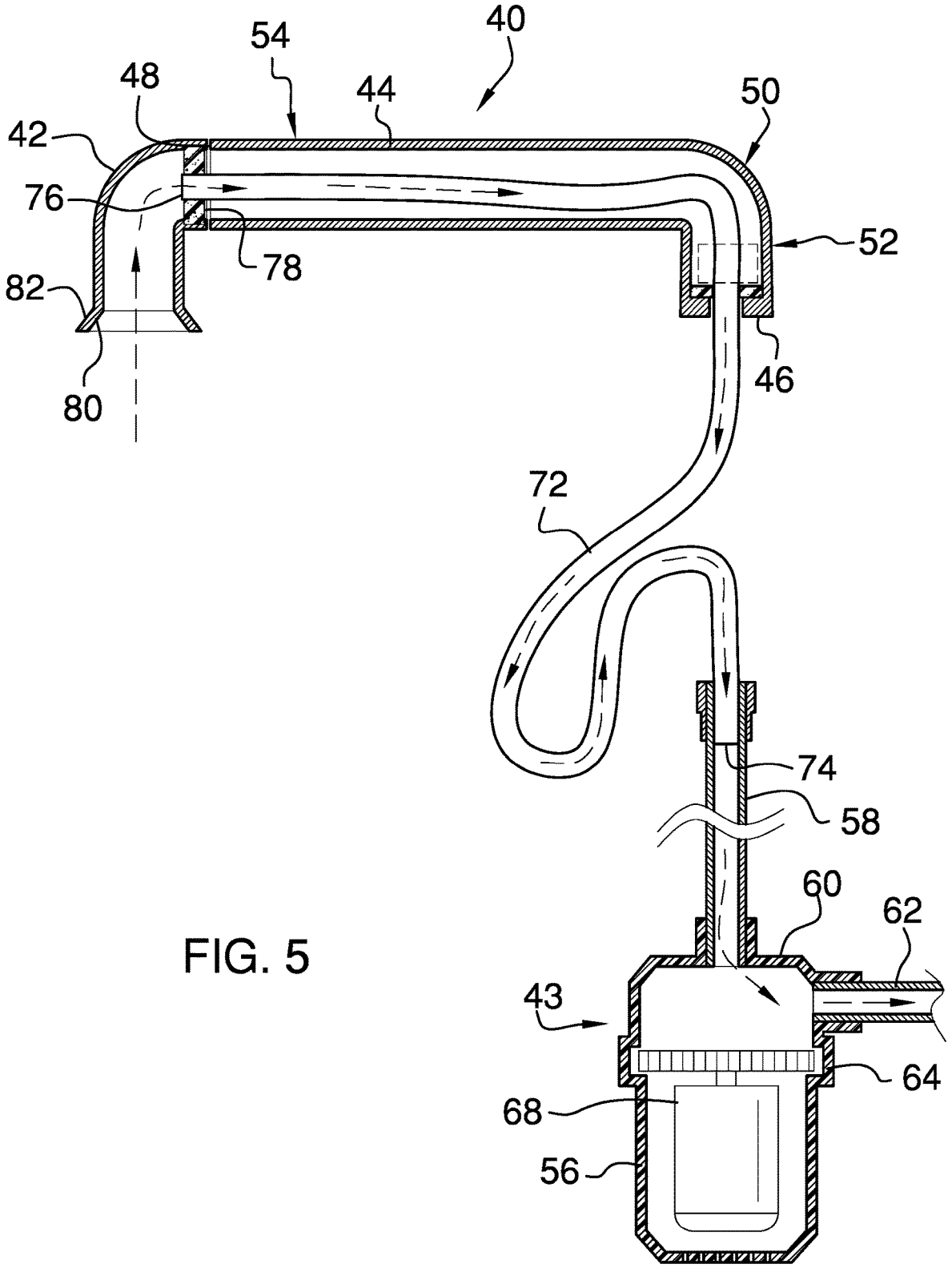
FIG. 5 is a cross sectional view taken along line 5-5 of FIG. 1 of an embodiment of the disclosure.

With reference now to the drawings, and in particular to FIGS. 1 through 5 thereof, a new vacuuming device embodying the principles and concepts of an embodiment of the disclosure and generally designated by the reference numeral 10 will be described.

As best illustrated in FIGS. 1 through 5, the vacuuming faucet assembly 10 generally comprises a faucet 12 that is integrated into a counter top 14 such that the faucet 12 is accessible to a user. The counter top 14 may be a kitchen counter top, a bathroom counter top or any other counter top that might be found in a house or office building. The faucet 12 has a fluid input 16 that is fluidly coupled to a water source 18 thereby facilitating the faucet 12 to pour water 20 from the water source 18. The faucet 12 comprises a base 22 that has a first end 24, a second end 26, a top side 28 and a bottom side 30. The base 22 is elongated between the first end 24 and the second end 26, and the bottom side 30 rests on the counter top 14.

The faucet 12 includes a spigot 32 that is coupled to and extends upwardly from the top side 28 of the base 22 and the spigot 32 is fluidly coupled to the fluid input 16 to receive the water 20 from the water source 18. The spigot 32 is centrally positioned between the first end 24 and the second end 26 and the spigot 32 may have a spout 34 that is rotatably integrated therein. The spout 34 is in fluid communication with the spigot 32 to receive the water 20. Moreover, the spout 34 may extend laterally away from the spigot 32 such that the spout 34 can extend over a sink 36 integrated into the counter top 14 for pouring water 20 into the sink 36. The sink 36 may be a kitchen sink, a bathroom sink or any other similar type of plumbing fixture. The spigot 32 may include a lever 38 that is movably integrated therein that can be manipulated by the user. Moreover, the lever 38 may actuate the spigot 32 between an open position and a closed position to either facilitate the spout 34 to pour the water 20 or to inhibit the spout 34 from pouring the water 20. Additionally, the spigot 32 may be a kitchen faucet or a bathroom faucet of any conventional design.

A pair of vacuum units 40 is each integrated into the faucet 12 such that each of the vacuum units 40 can be manipulated by the user. Each of the vacuum units 40 includes a suction port 42 that is in fluid communication with a vacuum source 43 to suck air therein when the vacuum source is turned on. Moreover, the suction port 42 on each of the vacuum units 40 is extendable away from a respective vacuum unit 40. In this way the suction port 42 on each of the vacuum units 40 can be positioned at various locations on the counter top 14 thereby facilitating the suction port 42 on each of the vacuum units 40 to suck water 20 from the counter top 14 to dry the counter top 14.

Each of the vacuum units 40 comprises an intake pipe 44 that has a first end 46 and a second end 48. The intake pipe 44 has a bend 50 thereon to define a first portion 52 forming an angle with a second portion 54. The first end 46 is associated with first portion 52 and the second end 48 is associated with the second portion 54. The first end 46 of the intake pipe 44 is coupled to the top side 28 of the base 22 such that the second portion 54 is oriented to extend along a horizontal axis. Additionally, the second portion 54 has a length that is greater than the length of the first portion 52.

Each of the vacuum units 40 includes a canister 56 that has an inlet 58 integrated into a top wall 60 of the canister 56. The canister 56 has an outlet 62 integrated into an outer wall 64 of the canister 56 and the outlet 62 is fluidly coupled to a drain 66 of the sink 36 that is integrated into the counter top 14. The drain 66 may comprise a fluid drain that is plumbed into a sewer system of the building in which the counter top 14 is installed. Each of the vacuum units 40 includes a vacuum 68 that is positioned within the canister 56. The vacuum 68 is in fluid communication between the inlet 58 of the canister 56 and the outlet 62 of the canister 56 to urge air inwardly through the inlet 58 and outwardly through the outlet 62 when the vacuum 68 is turned on. In this way the vacuum 68 in the canister 56 defines the vacuum source 43 for the suction port 42. Moreover, the vacuum 68 is electrically coupled to a power source 70 comprising an electrical system of a building in which the counter top 14 is positioned. The vacuum 68 may include an electric motor and a fan that is rotatably coupled to the motor which blows air outwardly through the outlet 62.

Each of the vacuum units 40 includes a hose 72 that has a primary end 74 and a secondary end 76, and the primary end 74 is fluidly coupled to the inlet 58 of the canister 56. In this way the vacuum 68 urges air inwardly through the secondary end 76 of the hose 72 when the vacuum 68 is turned on. The hose 72 extends through the bottom side 30 and the top side 28 of the base 22. The hose 72 extends through the first end 46 of the intake pipe 44 having the secondary end 76 being exposed with respect to the second end 48 of the intake pipe 44. Moreover, the hose 72 has a length that is sufficient to facilitate the hose 72 to be pulled outwardly through the second end 48 of the intake pipe 44.

The suction port 42 associated with each of the vacuum units 40 has a coupled end 78 and a free end 80, the suction port 42 is angled between the coupled end 78 and the free end 80, and each of the coupled end 78 and the free end 80 is open. The coupled end 78 is fluidly coupled to the secondary end 76 of the hose 72 such that the vacuum 68 can urge air inwardly through the free end 80 when the vacuum 68 is turned on. The suction port 42 is positionable in a stored position having the coupled end 78 abutting the second end 48 of the intake pipe 44.

The suction port 42 can be pulled away from the intake pipe 44 thereby facilitating the free end 80 to be moved around the counter top 14 to suctionally remove water 20 from the counter top 14 when the vacuum 68 is turned on. In this way the counter top 14 can be dried off when, for example, the user employs the sink 36 to wash their hands and water 20 gets splashed or spilled onto the counter top 14. Thus, the counter top 14 can be maintained in a sanitary condition thereby reducing the likelihood of the proliferation of bacteria on the counter top 14. Additionally, an outer wall 82 of the suction port 42 flares outwardly adjacent to the free end 80 to enhance suctionally removing the water 20 from the counter top 14.

A plurality of motion sensors 84 is included and each of the motion sensors 84 is integrated into a respective one of the faucet 12 and a respective one of the pair of vacuum units 40. In this way each of the motion sensors 84 can sense motion proximate the respective faucet 12 and the respective pair of vacuum units 40. The motion sensor 84 associated with the faucet 12 is positioned on an outer surface 86 of the spigot 32. Each of the motion sensors 84 that are associated with the pair of vacuum units 40 is positioned on an outer surface 88 of suction port 42 of the respective vacuum unit 40.

Each of the motion sensors 84 is directed toward the counter top 14 such that each of the motion sensors 84 can sense motion of the user when the user approaches the faucet 12 or the vacuum units 40. Moreover, each of the motion sensors 84 associated with the respective vacuum unit 40 is electrically coupled to the vacuum 68 of the respective vacuum unit 40. The vacuum 68 in the respective vacuum unit 40 is turned on when the motion sensor 84 associated with the respective vacuum unit 40 senses motion. Additionally, the vacuum 68 in the respective vacuum unit 40 is turned off when the motion sensor 84 associated with the respective vacuum unit 40 no longer senses motion. Each of the motion sensors 84 may comprise an infra-red motion sensor or any other type of electronic motion sensor that has a sensitivity range which ranges between approximately 1.0 feet and 3.0.

In use, the spigot 32 is employed in the conventional manner kitchen faucets or bathroom faucets to facilitate running water. Additionally, each of the vacuum units 40 is turned on when the motion sensors 84 senses motion. The suction port 42 associated with either of the vacuum units 40 can be pulled outwardly from the respective intake pipe 44 to suctionally remove water 20 that has spilled onto the counter top 14 when the spigot 32 is turned on. In this way the counter top 14 can be dried off to reduce the likelihood of bacterial proliferation on the counter top 14. Thus, the transmission of infectious diseases between individuals can be inhibited with respect to physical contact with the counter top 14. The suction port 42 associated with either of the vacuum units 40 can be positioned against the intake pipe 44 for storage once the water 20 from the counter top 14 has been removed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A vacuuming faucet assembly for either pouring water or vacuuming water from a surface, said assembly comprising:

a faucet being integrated into a counter top wherein said faucet is configured to be accessible to a user, said faucet having a fluid input wherein said fluid input is configured to be fluidly coupled to a water source thereby facilitating said faucet to pour water from the water source;

a pair of vacuum units, each of said vacuum units being integrated into said faucet wherein each of said vacuum units is configured to be manipulated by the user, each of said vacuum units including a suction port being in fluid communication with a vacuum source wherein said suction port on each of said vacuum units is configured to suctionally urge air therein when said vacuum source is turned on, said suction port on each of said vacuum units being extendable away from a respective vacuum unit wherein said suction port on each of said vacuum units is configured to be positioned at various locations on the counter top thereby facilitating said suction port on each of said vacuum units to suctionally remove water from the counter top to dry the counter top; and a plurality of motion sensors, each of said motion sensors being integrated into a respective one of said faucet and a respective one of said pair of vacuum units wherein each of said motions sensors is configured to sense motion proximate said respective faucet and said respective pair of vacuum units, respective ones of said motion sensors turning on said respective faucet or said respective vacuum unit when said respective motion sensor senses motion.

2. The assembly according to claim 1, wherein said faucet comprises a base having a first end, a second end, a top side and a bottom side, said base being elongated between said first end and said second end, said bottom side resting on the counter top.

3. The assembly according to claim 2, wherein said faucet comprises a spigot being coupled to and extending upwardly from said top side of said base, said spigot being fluidly coupled to said fluid input wherein said spigot is configured to receive the water from the water source, said spigot being centrally positioned between said first end and said second end.

4. The assembly according to claim 3, wherein said spigot has a spout being rotatably integrated therein, said spout being in fluid communication with said spigot wherein said spout is configured to receive the water, said spout extending laterally away from said spigot wherein said spout is configured to extend over a sink integrated into the counter top for pouring water into the sink.

5. The assembly according to claim 4, wherein said spigot includes a lever being movably integrated therein wherein said lever is configured to be manipulated by the user, said lever actuating said spigot between an open position and a closed position wherein said lever is configured to either facilitate said spout to pour the water or to inhibit said spout from pouring the water.

6. The assembly according to claim 2, wherein each of said vacuum units comprises an intake pipe having a first end and a second end, said intake pipe having a bend thereon to define a first portion forming an angle with a second portion, said first portion having said first end of said intake pipe being associated therewith, said second portion having said second end of said intake pipe being associated therewith, said first end of said intake pipe being coupled to said top side of said base having said second portion being oriented to extend along a horizontal axis.

7. The assembly according to claim 6, wherein each of said vacuum units includes a canister having an inlet being integrated into a top wall of said canister, said canister having an outlet being integrated into an outer wall of said canister wherein said outlet is configured to be fluidly coupled to a drain of the sink integrated into the counter top.

8. The assembly according to claim 7, wherein each of said vacuum units includes a vacuum being positioned within said canister, said vacuum being in fluid communication between said inlet of said canister and said outlet of said canister wherein said vacuum is configured to urge air inwardly through said inlet and outwardly through said outlet when said vacuum is turned on, said vacuum being electrically coupled to a power source comprising an electrical system of a building in which the counter top is positioned.

9. The assembly according to claim 8, wherein each of said vacuum units includes a hose having a primary end and a secondary end, said primary end being fluidly coupled to said inlet of said canister wherein said vacuum is configured to urge air inwardly through said secondary end of said hose when said vacuum is turned on.

10. The assembly according to claim 9, wherein said hose extends through said bottom side and said top side of said base, said hose extending through said first end of said intake pipe having said secondary end being exposed with respect to said second end of said intake pipe, said hose having a length being sufficient to facilitate said hose to be pulled outwardly through said second end of said intake pipe.

11. The assembly according to claim 9, wherein said suction port associated with each of said vacuum units has a coupled end and a free end, said suction port being angled between said coupled end and said free end, each of said coupled end and said free end being open, said coupled end being fluidly coupled to said secondary end of said hose wherein said vacuum is configured to urge air inwardly through said free end when said vacuum is turned on.

12. The assembly according to claim 11, wherein said suction port is positionable in a stored position having said coupled end abutting said second end of said intake pipe, said suction port being pullable away from said intake pipe wherein said free end is configured to be moved around the counter top to suctionally remove water from the counter top when said vacuum is turned on.

13. The assembly according to claim 11, wherein an outer wall of said suction port flares outwardly adjacent to said free end wherein said free end is configured to enhance suctionally removing the water from the counter top.

14. The assembly according to claim 3, wherein said motion sensor associated with said faucet is positioned on an outer surface of said spigot.

15. The assembly according to claim 11, wherein each of said motion sensors being associated with said pair of vacuum units is positioned on an outer surface of suction port of said respective vacuum unit, each of said motion sensors being directed toward the counter top wherein each of said motions sensors is configured to sense motion of the user when the user approaches said faucet or said vacuum units.

16. The assembly according to claim 15, wherein each of said motion sensors associated with said respective vacuum unit is electrically coupled to said vacuum of said respective vacuum unit, said vacuum in said respective vacuum unit being turned on when said motion sensor associated with said respective vacuum unit senses motion, said vacuum in said respective vacuum unit being turned off when said motion sensor associated with said respective vacuum unit no longer senses motion.

17. A vacuuming faucet assembly for either pouring water or vacuuming water from a surface, said assembly comprising:

a faucet being integrated into a counter top wherein said faucet is configured to be accessible to a user, said faucet having a fluid input wherein said fluid input is configured to be fluidly coupled to a water source thereby facilitating said faucet to pour water from the water source, said faucet comprising:

a base having a first end, a second end, a top side and a bottom side, said base being elongated between said first end and said second end, said bottom side resting on the counter top;

a spigot being coupled to and extending upwardly from said top side of said base, said spigot being fluidly coupled to said fluid input wherein said spigot is configured to receive the water from the water source, said spigot being centrally positioned between said first end and said second end, said spigot having a spout being rotatably integrated therein, said spout being in fluid communication with said spigot wherein said spout is configured to receive the water, said spout extending laterally away from said spigot wherein said spout is configured to extend over a sink integrated into the counter top for pouring water into the sink, said spigot including a lever being movably integrated therein wherein said lever is configured to be manipulated by the user, said lever actuating said spigot between an open position and a closed position wherein said lever is configured to either facilitate said spout to pour the water or to inhibit said spout from pouring the water;

a pair of vacuum units, each of said vacuum units being integrated into said faucet wherein each of said vacuum units is configured to be manipulated by the user, each of said vacuum units including a suction port being in fluid communication with a vacuum source wherein said suction port on each of said vacuum units is configured to suctionally urge air therein when said vacuum source is turned on, said suction port on each of said vacuum units being extendable away from a respective vacuum unit wherein said suction port on each of said vacuum units is configured to be positioned at various locations on the counter top thereby facilitating said suction port on each of said vacuum units to suctionally remove water from the counter top to dry the counter top, each of said vacuum units comprising:

an intake pipe having a first end and a second end, said intake pipe having a bend thereon to define a first portion forming an angle with a second portion, said first portion having said first end of said intake pipe being associated therewith, said second portion having said second end of said intake pipe being associated therewith, said first end of said intake pipe being coupled to said top side of said base having said second portion being oriented to extend along a horizontal axis, a canister having an inlet being integrated into a top wall of said canister, said canister having an outlet being integrated into an outer wall of said canister wherein said outlet is configured to be fluidly coupled to a drain of the sink integrated into the counter top;

a vacuum being positioned within said canister, said vacuum being in fluid communication between said inlet of said canister and said outlet of said canister wherein said vacuum is configured to urge air inwardly through said inlet and outwardly through said outlet when said vacuum is turned on, said vacuum being electrically coupled to a power source comprising an electrical system of a building in which the counter top is positioned;

a hose having a primary end and a secondary end, said primary end being fluidly coupled to said inlet of said canister wherein said vacuum is configured to urge air inwardly through said secondary end of said hose when said vacuum is turned on, said hose extending through said bottom side and said top side of said base, said hose extending through said first end of said intake pipe having said secondary end being exposed with respect to said second end of said intake pipe, said hose having a length being sufficient to facilitate said hose to be pulled outwardly through said second end of said intake pipe; and said suction port having a coupled end and a free end, said suction port being angled between said coupled end and said free end, each of said coupled end and said free end being open, said coupled end being fluidly coupled to said secondary end of said hose wherein said vacuum is configured to urge air inwardly through said free end when said vacuum is turned on, said suction port being positionable in a stored position having said coupled end abutting said second end of said intake pipe, said suction port being pullable away from said intake pipe wherein said free end is configured to be moved around the counter top to suctionally remove water from the counter top when said vacuum is turned on, an outer wall of said suction port flaring outwardly adjacent to said free end wherein said free end is configured to enhance suctionally removing the water from the counter top; and a plurality of motion sensors, each of said motion sensors being integrated into a respective one of said faucet and a respective one of said pair of vacuum units wherein each of said motions sensors is configured to sense motion proximate said respective faucet and said respective pair of vacuum units, said motion sensor associated with said faucet being positioned on an outer surface of said spigot, each of said motion sensors being associated with said pair of vacuum units being positioned on an outer surface of suction port of said respective vacuum unit, each of said motion sensors being directed toward the counter top wherein each of said motions sensors is configured to sense motion of the user when the user approaches said faucet or said vacuum units, each of said motion sensors associated with said respective vacuum unit being electrically coupled to said vacuum of said respective vacuum unit, said vacuum in said respective vacuum unit being turned on when said motion sensor associated with said respective vacuum unit senses motion, said vacuum in said respective vacuum unit being turned off when said motion sensor associated with said respective vacuum unit no longer senses motion.

* * * * *